United States Patent [19]

Reick

[11] 4,284,518

[45] Aug. 18, 1981

[54] STABILIZED HYBRID LUBRICANT

[75] Inventor: Franklin G. Reick, Westwood, N.J.

[73] Assignee: Michael Ebert, Mamaroneck, N.Y.

[21] Appl. No.: 158,329

[22] Filed: Jun. 10, 1980

Related U.S. Application Data

[60] Continuation-in-part of Ser. No. 914,908, Jun. 12, 1978, Pat. No. 4,224,173, which is a division of Ser. No. 809,805, Jun. 24, 1977, Pat. No. 4,127,491.

[51] Int. Cl.[3] ..... C10M 1/30; C10M 1/26; C10M 3/24; C10M 3/20

[52] U.S. Cl. ..... 252/16; 252/54.6; 252/58

[58] Field of Search ..... 252/16, 54.6, 58

[56] References Cited

U.S. PATENT DOCUMENTS

| | | | |
|---|---|---|---|
| 3,412,140 | 11/1968 | Seil et al. | 252/54.6 |
| 3,730,894 | 5/1973 | Heilweil et al. | 252/16 |
| 3,933,659 | 1/1976 | Lyle et al. | 252/75 |
| 3,956,154 | 5/1976 | Marolewski et al. | 252/78.1 |
| 4,203,856 | 5/1980 | Pardee | 252/54.6 |
| 4,213,870 | 7/1980 | Loran | 252/54.6 |

*Primary Examiner*—Delbert E. Gantz
*Assistant Examiner*—Irving Vaughn
*Attorney, Agent, or Firm*—Michael Ebert

[57] ABSTRACT

A hybrid lubricant in which a colloidal dispersion of solid lubricant particles (PTFE) is uniformly dispersed in a fluid lubricant carrier that includes a small but effective amount of a nonionic fluorochemical surfactant acting to stabilize the dispersion. When the hybrid lubricant is diluted with a major amount of a conventional fluid lubricant, it functions in the environment of rubbing surfaces to afford the benefit of both solid and fluid lubrication, thereby minimizing friction under all operating conditions regardless of their severity.

3 Claims, No Drawings

STABILIZED HYBRID LUBRICANT

RELATED APPLICATIONS

This application is a continuation-in-part of a copending application Ser. No. 914,908, filed June 12, 1978, now U.S. Pat. No. 4,224,173, which is a division of an application Ser. No. 809,805, filed June 24, 1977, now U.S. Pat. No. 4,127,491, the entire disclosure of which is hereby incorporated herein by reference.

BACKGROUND OF INVENTION

This invention relates generally to lubrication and lubricants, and more particularly to a hybrid lubricant in which solid lubricant particles are dispersed in a fluid lubricant carrier that includes a small but effective amount of a fluorochemical surfactant solution that acts to stabilize the dispersion and thereby prevent agglomeration of the particles.

Even the most carefully finished metal surfaces have minute projections and depressions therein which introduce resistance when one surface shifts relative to another. The application of a fluid lubricant to these surfaces reduces friction by interposing a film of oil therebetween, this being known as hydrodynamic lubrication. In a bearing, for example, the rotation of the journal causes oil to be drawn between it and the bearing so that the two metal surfaces are then separated by a very thin oil film. The degree of bearing friction depends on the viscosity of the oil, the speed of rotation and the load on the journal.

Should the journal start its rotation after a period of rest, it may not drag enough oil to float the surfaces apart; hence friction would then be considerably greater; the friction being independent of the viscosity of the lubricant and being related only to the load and to the "oiliness" property of the residual lubricant, causing it to stick tightly to the metal surfaces. This condition is referred to as "boundary lubrication," for the moving parts are then separated by a film of only molecular thickness. This may cause serious damage to overheated bearing surfaces.

The two most significant characteristics of a hydrodynamic lubricant are its viscosity and its viscosity index, the latter being the relationship between viscosity and temperature. The higher the index, the less viscosity will change with temperature. Fluid lubricants act not only to reduce friction, but also to extract heat developed within the machinery as well as a protection against corrosion.

Though fluid film separation of rubbing surfaces is the most desirable objective of lubrication, in practice it is often unobtainable. Thus bearings built for full fluid lubrication during most of their operating phases actually experience solid-to-solid contact when starting and stopping. Solid surfaces in rubbing contact are characterized by coefficients of friction varying between 0.04 (Teflon on steel) and $>100$ (pure metals in vacuo). In contrast to fluid lubrication, solid lubrication is usually accompanied by wear of rubbing parts. Optical inspection of the surfaces after rubbing invariably reveals microscopic damage of the metal both when unlubricated and lubricated.

Typical solid lubricants are soft metals such as lead, layer lattice crystals such as graphite and molybdenum disulphide, and crystalline polymers such as "FLUON" (polytetrafluoroethylene or PTFE). Integral bonding of these solid lubricants to the surfaces of the bodies to be lubricated is desirable for good performance.

Under severe operating conditions usually encountered in automotive transmissions and in internal combustion engines, hydrodynamic or fluid lubrication is inadequate to minimize friction and wear; for fluid film separation of the rubbing surfaces is not possible throughout all phases of operation. Hence, the ideal lubricant for engines or other mechanisms having moving parts is one combining hydrodynamic with solid lubrication. In this way, when adequate separation exists between the rubbing surfaces, a protective fluid film is interposed therebetween; and when these surfaces are in physical contact with each other, friction therebetween is minimized by interposing solid lubricants between these surfaces.

In theory, one can best approach this ideal by lining the rubbing parts of engines with solid lubricant layers which are integrally bonded thereto, concurrent use being made of a lubricating oil which functions not only to provide hydrodynamic lubrication but also to cool the rubbing parts. In addition, the oil may carry synthetic organic chemicals to carry out other functions to counteract wear and prevent corrosion.

The practical difficulty with attaining this ideal is that parts coated with solid lubricants, such as a PTFE layer, are very expensive and therefore add considerably to the overall cost of the engine. Moreover, in PTFE-coated parts which operate under rigorous conditions, the solid lubricant layers bonded thereto have a relatively short working life, so that it is not long before the only lubricant which remains effective in the engine is the fluid lubricant.

In order to provide lubricating activity that has both solid and fluid components, my prior U.S. Pat. No. 4,127,491 discloses a modified oil lubricant suitable for an internal combustion engine provided with an oil filter as well as for many other applications which call for effective lubrication throughout all phases of operation. This modified lubricant is constituted by major amounts of a conventional lubricating oil intermingled with minor amounts of an aqueous dispersion of polytetrafluoroethylene particles in the sub-micronic range in combination with a neutralizing agent which stabilizes the dispersion to prevent agglomeration and coagulation of the particles. The modified lubricant is therefore capable of passing through the oil filter without separating the solid particles from the oil in which it is dispersed.

This modified lubricant has many significant advantages; for, as indicated in my prior patent, it reduces wear and thereby prolongs engine life; it makes possible a sharp reduction in the emission of pollutants and also effect a significant improvement in fuel economy, the last factor being of overriding importance in a fuel-short world.

To charge-neutralize and stabilize the PTFE dispersion and thereby prevent the colloidal particles from settling out, my prior patent adds a fluorochemical surfactant to the dispersion before it is intermingled with a lubricant carrier to create the additive. While the fluorochemical surfactants disclosed in my prior patent are generally effective for their intended purpose, we have found that long-term stability is not always attained; for after several months the modified lubricant additive, when stored in a container, may be subject to a slight but a nevertheless undesirable settling action.

SUMMARY OF THE INVENTION

In view of the foregoing, the main object of this invention is to provide a hybrid lubricant in which a colloidal dispersion of solid lubricant particles (PTFE) is uniformly dispersed in a fluid lubricant carrier to form a hybrid lubricant additive that when diluted with a major amount of a conventional fluid lubricant functions in the environment of rubbing surfaces to develop a layer of solid lubricant on these surfaces, the long-term stability of the colloidal dispersion being enhanced by a fluorochemical surfactant whose normal foaming properties are inhibited in the context of the medium in which the surfactant is used.

Briefly stated, these objects are attained in a hybrid lubricant in which an aqueous dispersion of colloidal PTFE particles is treated with both a first fluorochemical surfactant which acts to charge-neutralize and stabilize the dispersion, and with a relatively small amount of a second fluorochemical surfactant having foam-generating characteristics that are inhibited in the context of the medium in which this surfactant is used to impart long-term stability to the hybrid lubricant, the dispersion so treated then being intermingled with a fluid lubricant carrier to form an emulsion.

In order to reduce the size of the globules in the emulsion, a dispersant polymer is added thereto to provide a homogenized emulsion to which is added an adsorbent surfactant having an affinity for the rubbing surfaces to which the lubricant is to be applied, thereby rendering these surfaces conducive to impregnation by the PTFE particles and the fusion of the particles thereto to create a solid lubricant layer when the surfaces are aluminum.

The use of a hybrid lubricant as an additive for standard crankcase oil in a diesel or internal combustion engine brings about distinctly better performance, increased mileage for a given amount of fuel, faster cold starts and an absence of hesitation. The additive reduces friction and wear, yet is resistant to coagulation and does not clog oil filters. And because the hybrid lubricant makes it possible to operate at lower idling speeds and with very lean air/fuel mixtures, the emission of unburned hydrocarbons and carbon monoxide from the exhaust is sharply reduced, thereby minimizing the discharge into the atmosphere of pollutants.

DESCRIPTION OF INVENTION

A hybrid lubricant in accordance with the invention includes a solid lubricant in the form of microfine particles of polytetrafluoroethylene (PFTE). Since these particles must pass easily through an oil filter and between closely machined metal surfaces such as those existing in hydraulic valve lifters, it is essential that the particles be of sub-micronic size. Suitable, therefore, as the starting material for a hybrid lubricant in accordance with the invention are the duPont "Teflon" dispersions TFE-42 and T-30 whose particle sizes are in the 0.5 to 0.05 micron range. Also acceptable is the "Fluon" ADO 38 TFE colloidal dispersion manufactured by ICI (Imperial Chemical Industries, Ltd.).

Techniques for producing tetrafluoroethylene polymers and dispersions thereof are disclosed in the Plunket U.S. Pat. No. 2,230,654 and the Renfrew U.S. Pat. No. 2,534,058 and the Berry U.S. Pat. No. 2,478,229. These TFE colloidal aqueous dispersions are all highly unstable. As noted in the publication of duPont, the manufacturer of "Teflon" brand dispersions:

> "Teflon 42 dispersion will settle on prolonged standing or a heating above 150° F. It can be redispersed by mild agitation. Stock being stored for an indefinite period should be redispersed at least every two weeks by inverting or rolling the container. High speed stirring or violent agitation should be avoided since this will cause irreversible coagulation. The dispersion should be protected from the atmosphere to prevent coagulation by drying. It should be protected against freezing at all times to prevent irreversible coagulation."
>
> "The T-30 and similar aqueous dispersions are hydrophobic colloids with negatively charged particles. In a dispersion in which 60% is in the form of solids, there are approximately 0.9 grams of Teflon for each cc of solution."

It is important that the reason for this inherent instability be understood. Though the colloidal particles generally carry a negative charge in an aqueous dispersion, the charges are not uniformly distributed. The negative charge varies over the particle surfaces and the particles, therefore, effectively behave as microscopic electrets having quasi-positive as well as negative charges. As a consequence, the bi-polar particles attract each other and agglomeration occurs. High-shear, heat, Brownian movement, adsorbed gases and the particle density all cause problems with unstable TFE dispersions.

It has been observed under a dark field microscope that the particles in an unstable PTFE dispersion can grow into clusters or spheroidal clumps that behave as gross particles. This growth or agglomeration continues until the surface charge becomes uniform. In some instances, the particles join together in linear chains to form long fiber-like clusters.

Under the microscope, the unstable dispersion in its virgin stage (i.e., fresh out of the reactor) appears as a galaxy of dispersed particles; but with agitation or stirring, the particles then proceed to agglomerate. Under high shear and impact, the agglomerates consolidate into a tough, gummy mass which is unsuitable in an oil additive, for it is easily filtered out in the circulating oil system.

Since the present invention uses essentially the same procedure for making a hybrid lubricant in accordance with the invention as is described in applicant's prior U.S. Pat. No. 4,127,491, except that the hybrid lubricant further includes an agent to impart long-term stability thereto, we shall first describe the steps involved without this agent.

STEP NO. 1

The aqueous dispersion of colloidal PTFE particles must first be rendered stable to avoid agglomeration of the particles. For this purpose, use is preferably made of a fluorochemical surfactant which acts to neutralize or stabilize the surface charges in the particles to make them more uniform and thereby prevent "electret" or other effects causing agglomeration.

Best results are obtained when the PTFE dispersion to be treated is received from the pressure reactor immediately following polymerization. PTFE particles are extremely hydrophobic and air tends to wet the particles better than water. It is for this reason that the solutions are usually shipped with a mineral oil layer to keep gases away and retard agglomeration. And while to make the hybrid lubricant, one may use commercially-available PTFE dispersions which have been shipped and stored as long as the dispersions are reasonably free of agglomerates, it is better to start with ex-reactor dispersions to sidestep the danger of agglomeration.

Fluorochemical surface active agents or surfactants are available which are anionic, cationic or nonionic. Among these fluoro surfactants are Zonyl (duPont) and Monoflor (ICI). Zonyl is a modified polyethylene glycol type that is nonionic. For engine lubrication applications, good results have been obtained with an anionic (−) fluoro surfactant commercially available from ICI as MF 32. MF 32, or Monflor 32 produced by ICI, is of particular interest, this being an anionic fluorochemical whose composition is 30% w/w/ active solids in diethylene glycol mono butyl ether.

STEP NO. 2

The stabilized aqueous PTFE dispersion produced in Step No. 1 is then intermingled with a fluid lubricant carrier, preferably one which is the same or fully compatible with the lubricating oil in the engine to which the hybrid lubricant is to be added. By intermingling the stabilized aqueous PTFE dispersion with the carrier, an emulsion is formed.

For this purpose, use may be made of Quaker State 10W-40 SAE lubricating oil, Shell X-100, or Uniflo oil. Thus, if Quaker State oil is normally used in the crankcase of the engine, the same oil may be used as the carrier for the dispersion.

STEP NO. 3

In the emulsion formed in step no. 2, the aqueous dispersion is distributed throughout the oil carrier in the form of relatively large globules. It is desirable that this emulsion be homogenized; that is, subjected to turbulent treatment to cause the globules to break up and reduce in size to create a fine uniform dispersion of colloidal PTFE in the fluid lubricant carrier.

To promote such homogenization, use is made of a polymeric dispersant such as ACRYLOID 956 manufactured by Rohm and Haas. This dispersant, which is generally used as a viscosity index improver or sludge dispersant, is a polyalkylmethacrylate copolymer in a solvent-refined neutral carrier oil. Also useful for this purpose are GANEX V516 polymeric dispersants manufactured and sold by GAF.

To obtain a very fine particle dispersion in the emulsion, this step is preferably carried out in two successive stages. In the first stage, a portion of the dispersant is sheared into the high viscosity Acryloid 956, after which the remainder is added.

STEP NO. 4

As a result of carrying out steps 1 to 3, we now have a homogenized emulsion in which stabilized PTFE particles are uniformly dispersed in a fluid lubricant carrier. In the final step, added to this emulsion is an adsorbent surfactant which will render the rubbing surfaces to be lubricated conducive to impregnation by the colloidal particles of solid lubricant, the impregnated particles fusing to those surfaces to create supersmooth and highly slippery layers thereon.

Where the surfaces to be lubricated are metal, the surfactant is one appropriate to metal. A preferred surfactant for this purpose is Surfy-nol 104 manufactured by Airco Chemicals and Plastics. This is a white, waxy, solid tertiary, acetylenic glycol which has an affinity for metal and functions as a wetting agent. It improves adhesion on metal due to its excellent wetting power.

Because of the effect of this non-ionic, adsorbent surfactant on metal surfaces, the colloidal PTFE particles in the hybrid lubricant which are brought in contact with these surfaces in the course of operation are impregnated into the granular interstices or voids in the metal and are fused thereto. The metals which react this way are aluminum and metals with a refractory or porous oxide surface.

For rubbing surfaces constituted by steel against anodized aluminum, the acid phosphate esters work well—such as GAFAC (free acids of complex phosphate esters made by GAF). These can be neutralized with amino silanes or propargyl alcohol to form lubricants with extraordinary low surface friction.

Suitable for high-speed, light duty application is Pegosperse, a polyethylene glycol, or 200 ML, a monolaurate, both made by Glycol Chem, Inc. IGEPAL CO520, made by GAF (General Analine & Film Corp.), is a non-ionic surfactant (dodecylphenoxy polyethylenoxy) which has the advantage of being easily removed by water. This is useful when the surface to be lubricated, such as a can formed in a can-forming machine, must later be cleaned.

Thus the choice of this surfactant is dictated by the nature of the surface to be lubricated. The selected surfactant must have an affinity for this surface and act to wet this surface to attract the PTFE particles.

The following is one preferred formulation in accordance with the invention described in my prior patent:

A. The starting material is 20 gm of an "ex-reaction" aqueous dispersion of colloidal PTFE (17% solids).

B. A fluorocarbon surfactant (Zonyl) is added (20 drops) to the TFE dispersion and the dispersion is gently mixed for adsorption to take place to produce a stabilized PTFE dispersion.

C. The stabilized dispersion is then high-sheared with 100 grams of an oil carrier, such as Quaker State 10W-40 SAE to form an emulsion.

D. The emulsion is then high-sheared with a dispersant polymer (100 grams of Acryloid 956) to homogenize the emulsion.

E. This homogenization is continued with an additional 100 grams of Acryloid 956.

F. The homogenized emulsion then is low sheared with 30 grams of Surfy-nol 440, an adsorbent surfactant for metal surfaces. Surfy-nol is the trademark of Airco Chemicals and Places for a group of organic surface-active agents (acetylenic alcohols or glycols or their ethoxylated derivatives; waxy or powdered solids, or liquids, non-foaming, non-ionic).

In practice, the hybrid additive may include halocarbon oil, the procedure for adding this oil being set forth in U.S. Pat. No. 4,127,491.

THE LONG-TERM STABILIZATION AGENT

To impart long-term stability to the hybrid lubricant, use is made of a small but effective amount of a fluorochemical surfactant solution that is characterized by an ability to produce stable foams in low polarity hydrocarbon liquids such as kerosene, xylene and crude oils. A preferred agent for this purpose is "Fluorad" FC-740, a Well Stimulation Additive manufactured by the Commercial Chemical Division of the 3M Company at St. Paul, Minn.

As described in the "Product Information" bulletin published in 1980 by the 3M Company, FC-740 is a solution of a nonionic fluorochemical surfactant belonging to the chemical class of fluorinated alkyl esters. It is the most effective member of that class with regard to its ability to foam low polarity hydrocarbon liquids.

Inasmuch as a foaming action would result in an undesirable oil-air froth, one must be careful to avoid foaming in the context of lubrication. At first blush, therefore, the inclusion of a surfactant having foam-generating characteristics would appear to be interdicted. However, it has been discovered that a fluorochemical surfactant solution having foam-generating characteristics will not give rise to foaming when used in a small but effective amount in the context of a hybrid lubricant additive in accordance with the invention, the surfactant then acting to significantly improve the long-term stability of the additive.

A surface active agent or surfactant is a compound that reduces interfacial tension between two liquids or between a liquid and a solid. Interface refers to the area of contact between two immiscible phases of a dispersion. At a fresh surface of either liquid or solid, the molecular attraction exerts a net inward pull. Hence the characteristic property of a liquid is surface tension, while that of a solid surface is adsorption. Both phenomena have the same cause; that is, the inward cohesive forces acting on the molecules at the surface. The wettability of solid particles such as PTFE is intimately associated with interfacial behavior.

A foam is a tightly packed aggregation of gas bubbles separated from each other by thin films of liquid. The properties of a liquid would not lead one to expect that thin films are capable of sustaining themselves for any appreciable amount of time against the effect of gravity. However, the existence and stability of a foam depend on a surface layer of solute molecules which form a structure quite different from that of the underlying film within the interbubble film.

On the other hand, defoaming agents act to inhibit the formation of foam or to destroy foam which has been formed. Defoaming agents may operate via a number of mechanisms, the most common being those of entry and/or spreading. One well-known defoaming agent which functions to repress foaming activity is a dispersion in hydrocarbon oil of fine particles of silica coated with silicone, the silicone surface rendering the particles hydrophobic. The defoaming action of this formulation is explainable on the basis of the entry mechanism. Because PTFE particles are hydrophobic, they are also capable of functioning as a defoaming agent, but they are not as effective as silicone-coated silica particles. Hence where a foaming agent is present in relatively large quantities in an oil medium having PTFE particles dispersed therein, these particles may not then succeed in defoaming the medium.

In the context of a hydrocarbon lubricant having a colloidal dispersion of PTFE particles therein in accordance with the invention, the inclusion of a nonionic fluorochemical surfactant solution having foam-generating characteristics, though serving to bring about a reduction in interfacial tension which acts to enhance the long-term stability of the dispersion, nevertheless does not give rise to undesirable foaming activity when the amount of surfactant employed for this purpose is relatively small.

It has been found that the inclusion of this foaming agent in the modified lubricant additive has the desired beneficial results if about 50 grams thereof are added to approximately 150 gallons of the hybrid lubricant additive. In practice, this stabilizing agent is added in the course of Step No. 1, so that the resultant hybrid lubricant additive includes in the preferred formulation not only a fluorochemical surfactant lacking foam-generating characteristics, but also a surfactant possessing foaming characteristics.

The fact that the inclusion of the foaming agent acts to enhance the stability of the hybrid lubricant additive has been established by tests. Thus when the additive was subjected to centrifugal activity for an hour in a vacuum ultra centrifuge operating at 35,000 RPM, no significant separation of the particles therein was detected.

The proportion of foam-generating surfactant to the quantity of hybrid lubricant additive to be treated thereby must be such as to enhance the long-term stability of the additive without, however, giving rise to foaming, the 50 grams of agent per 150 gallons of additive being given only by way of a preferred example.

While there has been shown and described a preferred embodiment of a stabilized hybrid lubricant in accordance with the invention, it will be appreciated that many changes and modifications may be made therein without, however, departing from the essential spirit thereof.

I claim:

1. A hybrid lubricant additive dilutable in a conventional fluid oil lubricant to provide a working lubricant applicable to metallic working surfaces such as those found in internal combustion engines, said hybrid lubricant additive comprising:

A: a colloidal dispersion of polytetrafluoroethylene particles having inherent defoaming characteristics;

B: a neutralizing agent added to said dispersion in an amount stabilizing the dispersion to prevent agglomeration of the particles;

C: a fluorochemical surfactant possessing foam-generating characteristics added to said dispersion in an amount insufficient to generate foam but sufficient to enhance the stability of the dispersion said surfactant is a nonionic surfactant belonging to the chemical class of fluorinated alkyl esters having an ability to foam low polarity hydrocarbon liquids; and D: a fluid oil lubricant carrier intermingled with the stabilized dispersion.

2. An additive as set forth in claim 1, wherein said carrier oil is a lubricating oil compatible with said conventional oil lubricant.

3. An additive as set forth in claim 1, wherein said neutralizing agent is a fluorochemical surfactant lacking foaming characteristics.

* * * * *